United States Patent [19]

Mathe

[11] 3,959,868

[45] June 1, 1976

[54] TOOL AND ADAPTER FOR ELECTRICAL CONNECTOR UNIT USING INSULATION PIERCING CONTACTS

[75] Inventor: Istvan Mathe, Cicero, Ill.

[73] Assignee: Bunker Ramo Corporation, Oak Brook, Ill.

[22] Filed: June 24, 1974

[21] Appl. No.: 482,547

Related U.S. Application Data

[63] Continuation of Ser. No. 370,037, June 4, 1973, abandoned.

[52] U.S. Cl. ..... 29/203 DT; 29/203 H; 29/629; 29/630 R

[51] Int. Cl.[2] ..... H01R 43/04

[58] Field of Search ..... 29/203 D, 203 DT, 203 H, 29/203 HC, 270, 278, 283, 629, 628, 630 R, 630 A, 203 P, 203 J, 200 J, 200 P; 339/99 R

[56] References Cited

UNITED STATES PATENTS

| | | | |
|---|---|---|---|
| 3,708,779 | 1/1973 | Enright et al. | 339/99 R |
| 3,711,921 | 1/1973 | Debertoli et al. | 29/203 H |
| 3,742,571 | 7/1973 | Brehm | 29/203 HT |
| 3,742,573 | 7/1973 | Kaufman | 29/203 H |
| 3,758,935 | 9/1973 | Long et al. | 29/203 HT |
| 3,803,695 | 4/1974 | Tucci | 29/203 H |
| 3,838,491 | 10/1974 | Mayberry et al. | 29/203 H |
| 3,842,392 | 10/1974 | Aldridge et al. | 339/99 R |

*Primary Examiner*—C. W. Lanham
*Assistant Examiner*—James R. Duzan
*Attorney, Agent, or Firm*—Frederick M. Arbuckle; William Lohff; David Bair

[57] ABSTRACT

A tool for controlled, uniform insertion of insulated conductors into insulation piercing contacts in an electrical connector unit includes a holding lug to engage the conductor and apply a holding pressure adjacent the free end of the conductor in one end of a terminal element channel of a contact member, an insertion blade for pressing the conductor into an insulation piercing notch of the terminal element, and an insertion guide to engage the conductor at a point immediately beyond the strain relief retainer of the connector unit and guide the conductor into the strain relief retainer. In one embodiment the tool is part of an adapter which becomes anchored to and remains as a part of the connector unit.

22 Claims, 19 Drawing Figures

FIG.1
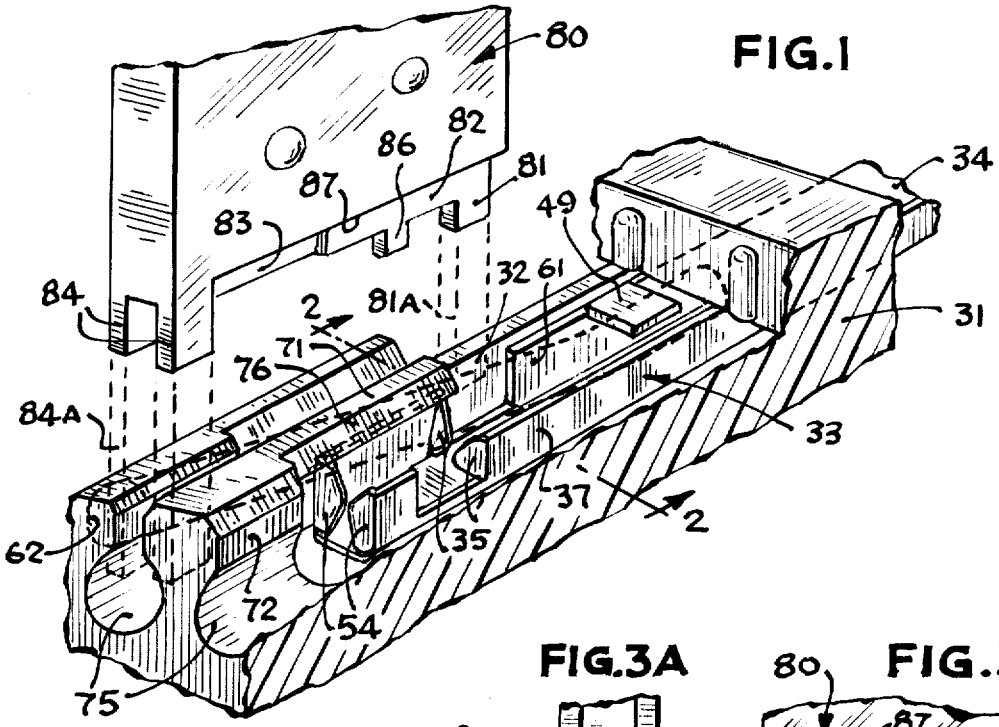
FIG.3A
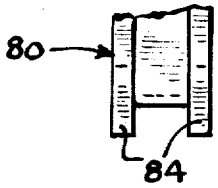
FIG.3B
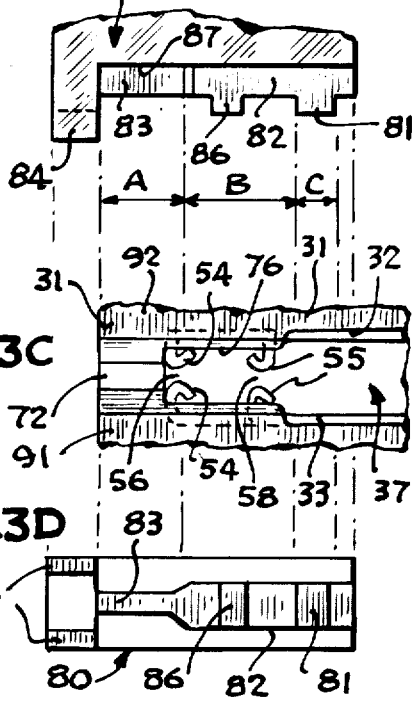
FIG.3C
FIG.3D
FIG.2
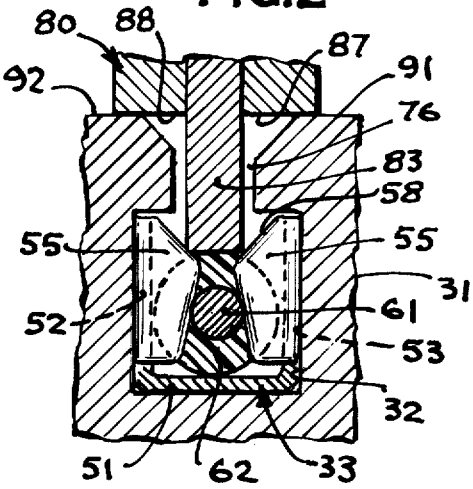
FIG.4
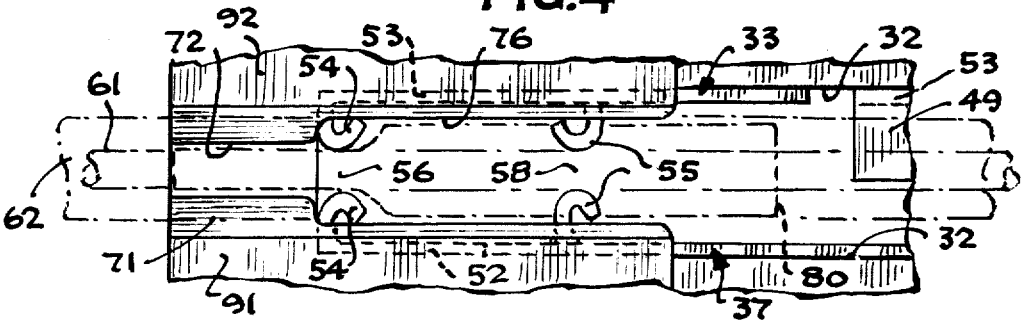

FIG. 9
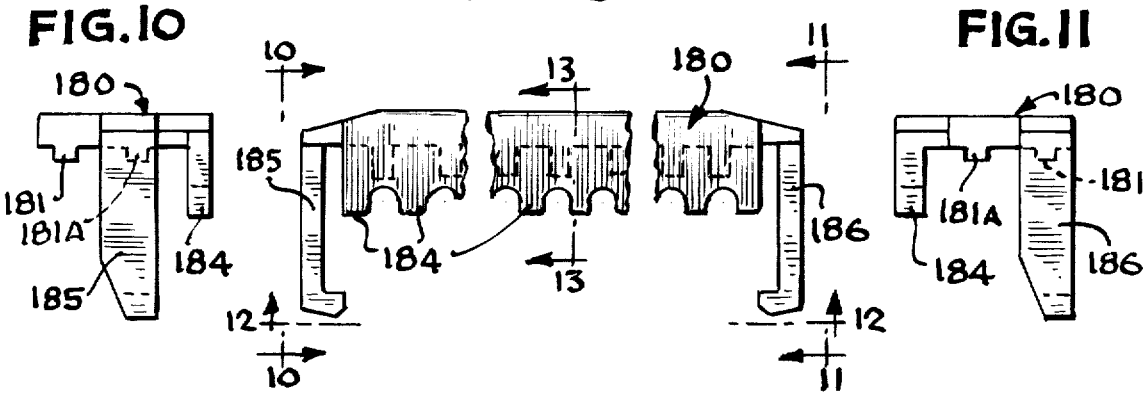
FIG. 10
FIG. 11
FIG. 12
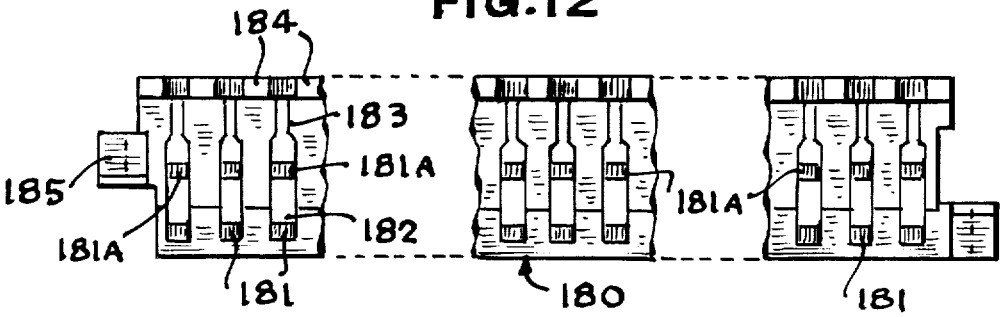
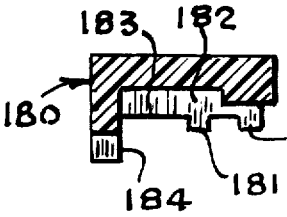
FIG. 13
FIG. 14
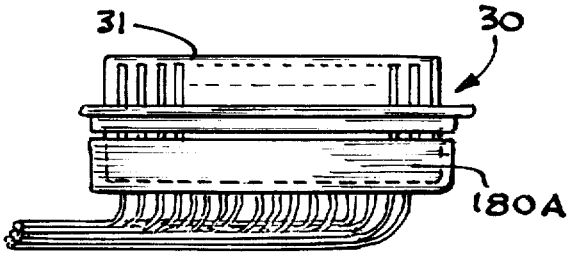
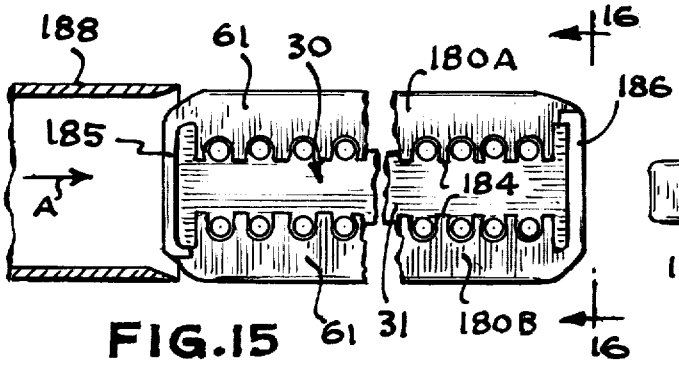
FIG. 15
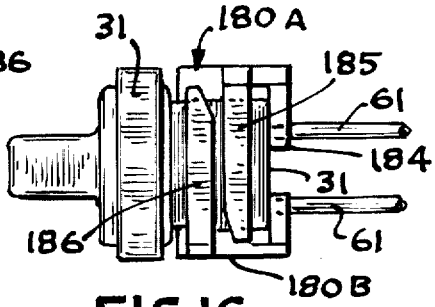
FIG. 16

TOOL AND ADAPTER FOR ELECTRICAL CONNECTOR UNIT USING INSULATION PIERCING CONTACTS

CROSS REFERENCES TO RELATED APPLICATIONS

This is a continuation of application Ser. No. 370,037, filed June 14, 1973, now abandoned.

The tool and adapter devices of the present invention are particularly advantageous when employed in conjunction with electrical contact members and connector units like those described and claimed in the copending application of Paul Hoppe, Ser. No. 288,998, filed Sept. 8, 1972.

BACKGROUND OF THE INVENTION

In multi-circuit electrical connectors, used in great variety and numbers in communication systems and other data handling systems, the usual technique for connecting individual solid or stranded wire conductors to the connector has been to strip the insulation from the end of the conductor and then solder the conductor to a connector contact. This procedure requires considerable skill on the part of the workman making the solder connection, particularly in miniaturized connectors. There is also a tendency to bridge adjacent contacts of the connector, producing undesired circuit connections.

An alternative technique, gaining increasing acceptance, uses insulation piercing terminals for the contact members of the connector; these terminals cut through the insulation and establish an electrical connection to the conductor without preliminary stripping and without the conventional soldering step. These insulation piercing terminals are usually of forked construction, with cutting edges that penetrate the wire insulation and that also serve as contact jaws that make the necessary electrical connection with the conductor. That is, a forked terminal element on the connector contact serves both as an insulation cutting device and as an electrical contact. A particularly advantageous and effective insulation piercing contact construction, which minimizes cutting into the conductor but provides a firm electrical and mechanical connection, is set forth in the aforementioned application of Hoppe, Serial No. 288,998.

Insertion of the individual conductors into the insulation piercing contacts of a connector unit, such as those shown in the aforesaid Hoppe application, can be accomplished with no special tools, other than an ordinary screwdriver or the like. However, there is a tendency toward inconsistency in carrying out this procedure; if too little pressure is applied and the conductor is incompletely seated, a poor electrical or mechanical connection may be realized, whereas application of excessive pressure may crush the insulation or even break the conductor. Too-deep insertion of a screwdriver or like tool can distort and also damage the insulation piercing elements of the connector contacts. Moreover, the conductor insertion process may still be relatively time-consuming and tedious, so that the advantages of the insulation piercing terminals, relative to soldered terminals, are not fully realized.

SUMMARY OF THE INVENTION

Accordingly, it is a principal object of the invention to provide a new and improved tool that effectively and inherently affords controlled, uniform insertion of the individual conductors into insulation piercing contacts in a connector unit, eliminating or minimizing the difficulties noted above.

It is a particular object of the invention to provide a new and improved conductor insertion tool, for use with insulation piercing contacts in a connector unit, that assures insertion to a predetermined depth in the terminal element of each contact member and into an adjacent strain relief container, without crushing the insulation on the conductor or distorting the insulation piercing elements of the contacts.

A further object of the invention is to provide a new and improved insertion tool for an electrical connector unit using insulation piercing contacts that permits simultaneous uniform insertion of a large group of conductors into an aligned bank of contact members in a multiple contact connector unit. A specific object of the invention is to provide a tool of the described nature that forms an integrated part of the completed composite connection unit structure.

Another object of the invention is to provide a new and improved electrical connector unit, utilizing open channel insulation piercing contact members, that includes a self-contained integral insertion adapter tool for inserting insulating electrical conductors into the insulation piercing portions of the contact members without damage to the conductor or the contact members while assuring establishment of good electrical contact in each contact member.

A related object of the invention is to provide an adapter tool, as described, that affords a protective cover for the contact members for the portions of the conductor mounted in the contact members, and for the strain relief portions of the connector unit.

Accordingly, the present invention relates to a tool for mounting an insulation covered electrical conductor in a contact member of a connector unit, the contact member including a terminal element comprising an elongated channel having one end shaped to receive the free end of the conductor and including at least one terminal flange with an outwardly open insulation piercing notch for piercing the conductor insulation to complete an electrical connection thereto at a point spaced from the free end of the conductor, the connector unit including a resilient outwardly open strain relief retainer for capturing the conductor at the other end of the terminal element. The tool comprises a holding lug for engaging the conductor adjacent its free end and applying a holding pressure to the conductor to maintain the free end of the conductor engaged in the aforesaid one of the terminal element channel. An insertion blade, aligned with the holding lug, is provided for pressing the conductor into the terminal element channel, into the insulation piercing notch of the terminal flange, and into the strain relief retainer. The tool preferably comprises a bifurcated insertion guide for embracing the conductor at a point immediately beyond the strain relief retainer to guide the conductor into the retainer; further, the preferred tool construction includes at least one stop element projecting laterally of the insertion blade to engage a connector unit surface and limit the depth of insertion of the blade into the terminal element channel.

BRIEF DESCRIPTION OF THE DRAWINGS

FIG. 1 is a sectional perspective view of one contact member of an electrical connector unit and of a tool, constructed in accordance with one embodiment of the present invention, for inserting an electrical conductor into the contact member;

FIG. 2 is a sectional view taken approximately along line 2—2 in FIG. 1 but drawn to a somewhat larger scale;

FIG. 3A is a detail end elevation view of the tool of FIG. 1;

FIG. 3B is a detail side elevation view of the tool;

FIG. 3C is a plan view of the terminal portion of an electrical contact of a connector unit, into which the tool is inserted in operation;

FIG. 3D is a bottom view of the tool;

FIG. 4 is a plan view, drawn to the same scale as FIG. 2, of a part of the contact mount of a connector unit, including the terminal portion of an insulation piercing contact member with which the tool of FIGS. 1 and 2 is employed;

FIG. 9 is a side elevation view of an adapter for incorporation into the connector unit of FIG. 5 that constitutes another embodiment of the invention;

FIG. 10 is an end view of the adapter taken along line 10—10 in FIG. 9;

FIG. 11 is an end view of the adapter taken along line 11—11 in FIG. 9;

FIG. 12 is a bottom view of the adapter, taken along line 12—12 in FIG. 9;

FIG. 13 is a sectional view taken approximately along line 13—13 in FIG. 9;

FIG. 14 is a side elevation view, on a reduced scale, of the connector unit of FIG. 5, showing an adapter releasably mounted on the connector unit;

FIG. 15 is a detail view illustrating the manner in which a connector unit housing serves to assemble two adapters by pressing the adapters into the connector unit; and FIG. 16 is an end elevation view of the assembled connector unit taken approximately along line 16—16 in FIG. 15.

DESCRIPTION OF THE PREFERRED EMBODIMENTS

Figure 8:
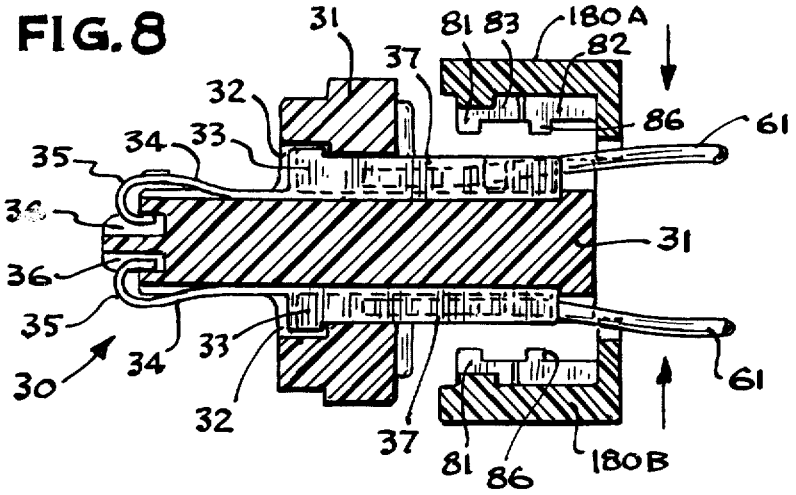
FIG. 8 is a sectional elevation view, on an enlarged scale, of a connector unit incorporating an adapter constructed in accordance with the present invention, taken approximately along line 8—8 in FIG. 5.
Figure 5:
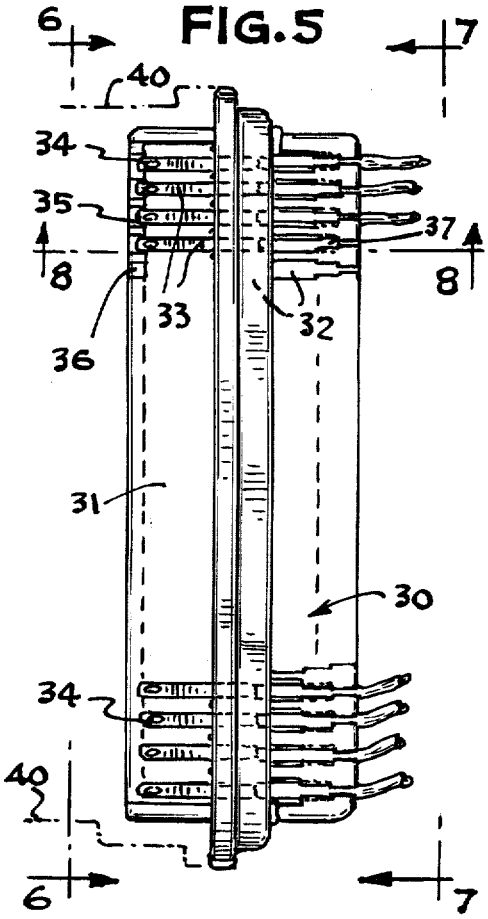
FIG. 5 is a side elevation view of a complete connector unit, excluding the housing, of the kind with which the tool of FIGS. 1–4 is employed.

FIGS. 1–8 illustrate the basic structure of an electrical plug connector unit 30 utilizing contact members with self-piercing terminals and FIGS. 1–4 illustrate a simple single conductor insertion tool 80 constructed in accordance with one embodiment of the present invention. The electrical connector unit 30 is shown in FIGS. 5, 6, 7 and 8, and parts of the connector unit are shown in greater detail in FIGS. 1–4. Connector unit 30 includes a contact mount 31 of molded dielectric material having a plurality of individual contact mounting passages 32; each of the passages 32 extends completely through mount 31, as indicated in FIGS. 1, 5 and 8. Connector unit 30 further includes a corresponding plurality of contact members 33, each of the contact members 33 being mounted in one of the contact passages 32 (FIGS. 1, 2, 5 and 8). Each contact member 33, as shown in FIGS. 5 and 8, includes an active contact element 34 comprising a thin, flat, resilient metal element bent into a re-entrant hook configuration at the end 35 to engage in a small retaining slot 36 formed in mount 31 at one end of passage 32. Contact member 33 further comprises an integral terminal element 37 which is positioned near the external end of the contact passage 32 (FIGS. 4, 5, and 8). Plug unit 30 fits into a complementary receptacle unit, shown only by the phantom outline 40 in FIG. 5; for details of the receptacle unit construction, reference may be made to the aforementioned Hoppe application, Ser. No. 288,998. The receptacle unit 40 may use the same kind of contacts as the contact members 33 of plug unit 30, and the tools and adapters of the present invention function equally well in the assembly of receptacle units and plug units. In the illustrated connector unit 30, FIGS. 5–8, there are a total of 50 contact members 33; this number may vary substantially, depending on the number of circuits to be interconnected.

Figure 6:
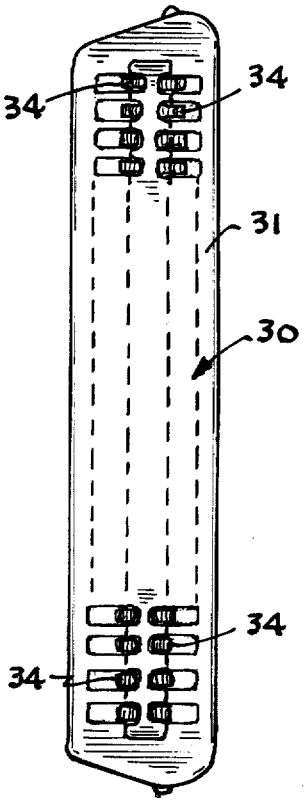
FIG. 6 is an end elevation view taken approximately as indicated by line 6—6 in FIG. 5.
Figure 7:
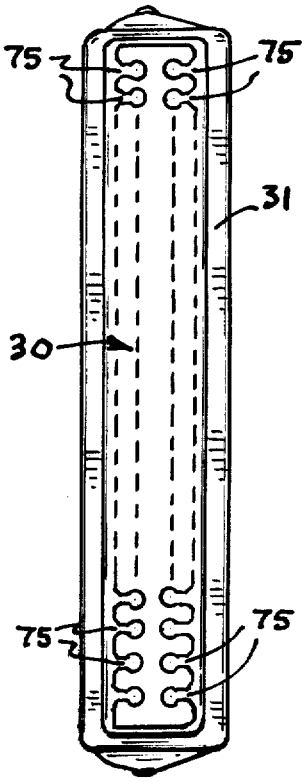
FIG. 7 is an end elevation view taken approximately as indicated by line 7—7 in FIG. 5.

As thus far described, and as illustrated in FIGS. 5–7, the construction of the connector plug unit 30 is generally similar to that employed in the multiple-contact electrical connector units described and illustrated in Yopp Pat. No. 3,002,176. The individual contact members 33 can be readily and rapidly mounted in the plug mounting block 31 by inserting the contact members into the forward ends of the individual contact passages 32 insertion is from the left side of connector unit 30 in the orientation shown in FIG. 8. In the electrical connectors of the Yopp patent, the terminal elements of the individual contact members are of channel shaped configuration, and electrical connections to individual conductors are effected by conventional soldering techniques. For the contact members 33 with which the present invention is employed, however, soldering is not utilized. That is, the unitary contact members 33, each formed from a single piece of thin conductive sheet metal, include provision for solderless insulation-piercing connection to an insulated electrical conductor simply by insertion of the electrical conductor into the terminal element of the contact member.

FIGS. 1, 2 and 4 illustrate, on a greatly enlarged scale, one construction that may be employed for the terminal element 37 formed at the external end of each of the contact members 33. It should be noted that in this specification the term "external", as applied to either a contact member or to a contact passage in the contact mount of the electrical connector, refers to the portion into which individual electrical conductors extend and are connected. It will be recognized that the configuration of the connector unit 30 can be changed so that the terminal elements 37 of the contact members 33 are not linear extensions of the active contact elements 34 without changing this relationship.

The external end of contact member 33, comprising terminal element 37, as shown in FIGS. 1, 2 and 4, comprises an elongated channel of U-shaped cross sectional configuration having a bottom wall 51 and side walls 52 and 53. A retainer tab 49 is formed integrally with side wall 53. Tab 49 is shown bent over at approximately 90° to the top of side wall 53, this being the position of the tab when contact member 33 is inserted in the dielectric mount 31 (FIG. 1). Once the contact member 33 is in place in dielectric mount 31, tab 49 may be bent upwardly to hold contact member 33 in passage 32, or may remain in its original position as shown in FIG. 1 if a tight fit is afforded between contact member 33 and passage 32.

Terminal element 37 of contact member 33 includes two terminal flanges 54 and 55. Flange 54 is formed by two flange elements, struck from side walls 52 and 53 respectively. The two flange elements of flange 54 are bent across the end of the channel constituting terminal element 37, forming an upwardly opening notch 56 (FIG. 4). The upper portion of notch 56 has downwardly converging thin-edged walls that afford a cutting section for shearing through the insulation on an insulated electrical conductor. The medial portion of notch 56 is preferably formed with gradually thickened edges, constituting a transition section for spreading the insulation away from a conductor inserted in the notch. The lower portion of notch 56 preferably has smooth, round edges along its walls that constitute a slightly diverging pressure jaw which engages an electrical conductor in wiping contact.

The second terminal flange 55 of terminal element 37 (FIGS. 2 and 4) is similar in construction to flange 54. It includes a first flange element struck from channel wall 52 (FIGS. 2 and 4) and bent inwardly across the channel. A second flange element is struck from wall 53 and bent inwardly across the channel in alignment with the first flange element. Both of the flange elements are formed with sloping upper walls and are bent back upon each other to afford a notch 58 having a cutting section, a transition section, and a terminal section as described for flange 54.

To complete an electrical connection to terminal element 37, a conductor 61 with an electrical insulation covering 62 is inserted into the two notches 56 and 58 in the terminal flanges 54 and 55 as generally indicated in FIGS. 2 and 4. As the insulated conductor is forced downwardly into the notches in the two terminal flanges, the converging notch walls (see FIG. 2) cut into the insulation 62 on the conductor 61 in a shearing action. As the conductor is forced further downwardly into notch 58 in flange 55, the gradually thickened walls of the notch tend to spread the insulation and thus expose the underlying conductor 61. The lower folded portions of the notch walls engage the conductor 61 without cutting into it and apply a full normal force in sliding friction contact with the conductor. The same action occurs in notch 56 of terminal flange 54. In FIG. 2, the final position of an electrical conductor 61 with an insulating cover 62 is shown in terminal flange 55, with the electrical connection completed. The final position is the same for flange 54. Connector unit 30 includes a series of strain relief retainers that are molded integrally with the dielectric contact mount 31. As shown in FIGS. 1, 2, 4, 5, and 7, mount 31 includes an integral molded barrier 71 extending across the outer ends of all of the contact passages 32. Barrier 71 includes a plurality of narrow outwardly diverging open retainer access slots 72, one slot 72 aligned with and communicating with the outer external end of each passage 32. At the base of each slot 72 there is a wider retainer section 75 that is approximately equal in its inner diameter to the outside diameter of the insulator covering 62 on conductor 61. A continuation 76 of each slot 72 affords access to the terminal flanges 54 and 55 in terminal element 37; the width of slot continuation 76 is preferably not substantially smaller than the full diameter of the insulation 62 on conductor 61 (see FIG. 2).

When an insulated conductor is inserted through continuation slot 76 for connection to the terminal portion 37 of one of the contact members 33, the conductor is also driven down through access slot 72 and into the strain relief retainer section 75. The insulated conductor is firmly gripped in retainer section 75. During insertion, the walls of slot 72 may spread somewhat, and the insulation 62 on conductor 61 is compressed, but these elements then snap back into the illustrated retention position, FIG. 4.

FIGS. 1, 3A, 3B, 3D and 4 illustrate a mounting tool 80 constituting an initial simple embodiment of the present invention that is utilized for mounting a single insulation covered conductor 61 in the terminal element 37 of one of the contact members 33 and in the strain relief retainer section 75 associated with that contact element. Tool 80, which in this instance may be fabricated from steel, includes a downwardly projecting holding lug 81 located near one end of the bottom edge of the tool. An insertion blade 82 extends forwardly from holding lug 81 toward the external end of the tool. The part of blade 82 adjacent lug 81 is as wide as lug 81, the width of these elements being only somewhat smaller than the overall diameter of the insulated conductor. The external end 83 of the insertion blade 82 is narrower so that this section 83 of the insertion blade fits easily through the access slot 72 leading to strain relief retainer section 75. The external end of tool 80 comprises a bifurcated insertion guide 84 just wide enough to embrace the outer surfaces of the insulation 62 on conductor 61. A second lug 86 (FIGS. 1, 3B and 3D) may be provided, on insertion blade 82, for insertion into terminal element 37 between flanges 54 and 55 (FIG. 3C) to press the insulated conductor against the bottom of the terminal element channel intermediate the two connection flanges.

In the use of tool 80, the insulated conductor 61 is inserted into the internal end of the channel of terminal element 37 of contact member 33, in the manner generally indicated by the dash outline of the insulated conductor in FIG. 1. Tool 80 is then aligned with contact passage 32 and contact member 33 as shown in FIG. 1 and as generally indicated by the alignment of the tool and contact member in FIGS. 3B and 3C. Tool 80 is then moved downwardly, engaging the external end of conductor 61 in the bifurcated guide 84 of the tool. Thus, guide 84 holds the external end of the conductor in alignment with terminal element 37 of contact member 33 and with the access slot 72 of the resilient strain relief retainer for the connector unit.

Continued downward movement of tool 80 brings lugs 81 and 86 into engagement with the insulated conductor 61 in alignment with the portion of the conductor that is adjacent the internal end of terminal element 37. In this manner, the downward movement of the tool applies a holding pressure, via lug 81, to the insulated conductor 61 to maintain the free end of the conductor engaged in the bottom of the internal end of the terminal element 37. Continued downward movement of the tool, toward the final position generally indicated by dash outlines 81A and 84A, causes the insertion blade 82, 83 to press the insulated conductor into the channel of terminal element 37 and into the access slot 72 of the strain relief retainer. In the final downward movement of tool 80, the insertion blade presses the conductor into the insulation piercing notches 56 and 58 of terminal flanges 54 and 55 and completes the requisite electrical connection between conductor 61 and contact member 33. At the same time, the external end of the insulated conductor is forced into the retainer section 75 at the bottom of slot 72, so that the insulated conductor is firmly gripped and retained in its connection position. The additional lug 86, if incorporated in tool 80, assures bottoming of the conductor within terminal element 37, between flanges 54 and 55.

In the use of tool 80, the insulated conductor 61 is not allowed to escape from the channel-shaped terminal 37 of contact member 33, but is controlled throughout the connection operation. The electrical connection is completed without excessive distortion or crushing of the insulator; major permanent distortion of the insulator is effectively limited to the piercing and spreading of the insulation at the points of engagement with terminal flanges 54 and 55. The complete electrical connection at flange 55 is shown in FIG. 2. Some limited distortion of the insulation may occur at the parts of the conductor engaged by lugs 81 and 86. The insulation 62 is compressed somewhat as the conductor is moved through slot 72, but this compression is not excessive and the insulator comes to reset in the retainer portion 75 of the contact passageway, held firmly in place without damage to the insulation on the conductor. Because the external end of conductor 61 is continuously guided by its engagement in the bifurcated insertion guide 84, the conductor is not bent to an undue extent (some limited bending may occur, depending on the dimensions of guide 84) and the integrity of the conductor and its insulation is effectively maintained.

As tool 80 presses conductor 61 downwardly into strain relief retainer 75 and into terminal element 37, the two shoulders 87 and 88 on opposite sides of insertion blade 82, 83 engage the upper surfaces 91 and 92 of contact mount 31 on the opposite sides of access slot 72 and continuation slot 76. This engagement affords a positive stop for tool 80 (FIG. 2). As a consequence, uniform controlled insertion of conductor 61 is effected, all the way to the bottom of terminal element 37 and into retainer section 75, with no danger of crushing or cutting the insulation 62 except in the terminal flange notches 56 and 58. Furthermore, there is no damage to the terminal flanges 54 and 55.

FIGS. 9 through 16 illustrate another embodiment of the present invention, in which the mounting tool is incorporated in multiple form in an adapter 180 that is utilized to mount a complete series or set of conductors 61 in the connector unit 30 simultaneously; the adapter tool 180 becomes an integral part of the completely assembled connector unit. The construction of adapter tool 180 is best illustrated in FIGS. 8–12. Adapter 180 is preferably a single, unitary molded plastic member. It comprises a plurality of holding lugs 181 (FIGS. 12 and 13), one holding lug for each contact member in a series of connector unit contacts. The holding lugs 181 having the same spacing and alignment as the terminal elements 37 of the contact members 33 of connector unit 30. Each holding lug 181 is aligned with an insertion blade 182 that tapers down to a narrow insertion blade section 183. Additional lugs 181A, corresponding to lug 86 in tool 80, may also be provided. At the external edge of adapter 180, the upper edge as seen in FIG. 12, the narrow section 183 of each insertion blade terminates at an opening forming a bifurcated insertion guide 184. Insertion guides 184 are also clearly illustrated in FIGS. 9 and 13. It is thus seen that adapter 180 affords an integrated series of insertion tools corresponding in construction to the individual insertion tool 80 described in connection with the first embodiment of the invention (FIGS. 1–4).

A first anchoring arm 185 is formed on one end of adapter tool 180, extending downwardly from the center of one side of the adapter as shown in FIGS. 9 and 10. At the opposite end of adapter 180, there is a second depending anchor arm 186 that is spaced from the bifurcated guides 184 by the full width of the adapter (FIGS. 9 and 11).

The offset of anchor arms 185 and 186 makes it possible to produce two adapters, from a single mold, that can be employed with a connector unit, like connector unit 30, having two sets of contact members.

In utilizing adapter 180 in the assembly of conductor 61 into connector unit 30, two adapters 180A and 180B are aligned with the two sets of contact terminal elements 37 of the connector unit in the manner illustrated in FIG. 8. Adapter 180A is pressed downwardly to mount all of the conductors 61 in the terminal elements 37 of the contact members 33 in one side of connector unit 31. From the position shown in FIG. 8, the other adapter 180B is moved upwardly to mount the conductors 61 in the terminal elements 37 of contact members 33 on the opposite side of connector unit 31. As each of the adapter members 180A and 180B is thus moved toward the contact mount 31 of connector unit 30, the holding lug 181 of each of the insertion tools formed integrally with the adapter engages the internal end of its aligned conductor 61 and holds the conductor in place with its free end engaged in the internal end of the terminal element 37 of the related contact member 33. The insertion blade 182 aligned with each conductor presses the conductor into the terminal element channel, into the insulation-piercing notches of the terminal flanges in the terminal element, and into the aligned strain relief retainer aligned with the external end of the contact. During the complete mounting operation, the external portion of each of the conductors 61 is guided by engagement in one of the bifurcated insertion guides 184, just as in operation of the previously described embodiment and pressed to the bottom of the strain relief retainer.

The complete assembly of connector unit 30, utilizing the two adapters 180A and 180B, is shown in FIGS. 15 and 16. The anchoring arms 185 and 186 of adapter 180A snap over the opposite ends of contact mount 31. Similarly, the anchor arms 185 and 186 of the other adapter member 180B snap over the opposite ends of contact mount 31, in side-by-side relation to the anchor arms of adapter 180A. As best seen in FIG. 16, the anchor arms 185 and 186 of the two adapters 180A and 180B, due to their asymmetrical location relative to the width of each adapter, afford a convenient and effective means for anchoring the two adapters in mounted position when they have completed the task of uniform and positive insertion of the conductors 61 into the terminal elements of the connectors unit contact members.

Each anchoring arm of adapters 180A and 180B has a free end 189 with a taper 190 so that when the adapters are pressed on opposite ends of a connector unit the adjacent anchoring arms slide by each other without interference. Mounting of adapters 180A and 180B not only assembles conductors 61 in connector unit 30 but also provides a cover over terminal elements 37 (see FIGS. 8 and 14–16) and over the pierced conductor portions inserted therein.

Subsequently, a hood or housing 188 can be inserted over the two adapters 180A and 180b, as indicated by arrow A in FIG. 15, to afford a further positive retention of the adapter tools on the connector unit if desired. Hood 188 also conveniently serves to mount adapter units 180A and 180B into the completely assembled connector unit 30. Adapters 180A and 180B are pressed together at a common end of a connector unit 30 and hood 188 is slid over the common end and moved along the adapters, causing the adpaters to insert conductors 61 sequentially into unit 30.

As clearly shown in FIG. 14, the adapters do not appreciably increase the overall size of connector unit 30. The integral adapters 180 can each be formed as a single molded plastic member. They materially accelerate the assembly of connector unit 130, particularly in multiple contact connector units that require connection to a substantial number of conductors. Using the adapter tools 180, the complete connector unit can be assembled to its conductor wires in a matter of minutes, by simply inserting each of the wires in the appropriate contact member terminal element and then pressing the two adapter tools into place as described above and as shown in FIGS. 14 and 16. As in tool 80, the shoulders adjacent the insertion blades 182 of adapter 180 serve as positive stop means for limiting the movement of the insertion blades into the terminal elements and into the strain relief retainers of the connector unit, assuring uniform electrical connections but precluding damage to the insulation piercing contacts and avoiding unwanted crushing or cutting of the conductor insulation.

I claim:

1. A tool for mounting an insulation-covered electrical conductor in a contact member of a connector unit, the contact member including a terminal element comprising an elongated channel having one end shaped to receive the conductor and including at least one terminal flange with an outwardly open insulation piercing notch for piercing the conductor insulation to complete an electrical connection to the conductor, the connector unit including a resilient outwardly open strain relief retainer for capturing the conductor at the other end of the terminal element, the tool comprising:

a holding lug for engaging the conductor and applying a holding pressure to the conductor to maintain the conductor engaged in said one end of the terminal element channel;

an insertion blade, aligned with the holding lug, for pressing the conductor into the terminal element channel, into the insulation piercing notch of the terminal flange, and into the strain relief retainer;

and a bifurcated insertion guide for embracing the conductor at a point immediately beyond the strain relief retainer to guide the conductor into the retainer.

2. An electrical condcutor mounting tool according to claim 1, and further comprising at least one stop element projecting laterally of the insertion blade to engage a surface of the connector unit and limit the depth of insertion of the insertion blade into the terminal element channel.

3. An electrical conductor mounting tool according to claim 1, for use with a connector unit in which the strain relief retainer comprises an integral part of a molded dielectric contact mount, with a narrow access slot aligned with the terminal element channel, said tool further comprising two stop shoulders projecting laterally of the opposite sides of the insertion blade and engageable with the outer surfaces of the contact mount adjacent the acess slot to limit the depth of insertion of the insertion blade into the terminal element channel.

4. An electrical conductor mounting tool according to claim 1, for use with a connector unit comprising a molded-dielectric contact mount defining a narrow access slot to the strain relief retainer aligned with a wider access slot over the terminal flange of the terminal element, in which the insertion blade of the tool includes a narrow strain relief insertion section aligned with a wider terminal flange insertion section.

5. An electrical conductor mounting tool according to claim 1 and further comprising a second holding lug, the two holding lugs engaging the conductor on opposite sides of the terminal flange in the terminal element.

6. A tool for mounting an insulation-covered electrical conductor in a contact member of a connector unit, the contact member including a terminal element comprising an elongated channel having one end shaped to receive the conductor and including at least one terminal flange with an outwardly open insulation piercing notch for piercing the conductor insulation to complete an electrical connection to the conductor, the connector unit including a resilient, outwardly open strain relief retainer for capturing the conductor at the other end of the terminal element, the tool comprising:

a holding lug for engaging the conductor and applying a holding pressure to the conductor to maintain the conductor engaged in said one end of the channel;

an insertion blade, aligned with the holding lug, for pressing the conductor into the terminal element channel, into the insulation piercing notch of the terminal flange, and into the strain relief retainer;

and at least one stop element for engaging a surface of the connector unit and limiting the depth of insertion of the insertion blade in the insulation piercing notch to avoid damage to the terminal flange.

7. An electrical conductor mounting tool according to claim 6, for use with a connector unit comprising a molded dielectric contact mount defining a narrow access slot to the strain relief retainer aligned with a wider access slot over the terminal flange of the terminal element, in which the insertion blade of the tool includes a narrow strain relief insertion section aligned with a wider terminal flange insertion section.

8. An electrical conductor mounting tool according to claim 6 and further comprising a second holding lug, the two holding lugs engaging the conductor on opposite sides O of the terminal flange in the terminal element.

9. An adaper tool for simultaneously mounting a plurality of insulation-covered electrical conductors in a corresponding plurality of contact members in a connector unit, each contact member including a terminal element comprising an elongated channel having one end shaped to receive a conductor and including at least one terminal flange with an outwardly open insulation piercing notch for piercing the conductor insulation to complete an electrical connection to the conductor, the connector unit including a corresponding plurality of resilient outwardly open strain relief retainers, one for each contact member, for capturing the conductor at the other end of the terminal element, the adapter tool comprising:

a corresponding plurality of holding lugs, one for each contact member, each adapted to engage one conductor and apply a holding pressure to the conductor to maintain the conductor engaged in said one end of the terminal element channel of a given contact member;

a corresponding plurality of insertion blades, each aligned with one holding lug, for pressing the conductors into the terminal element channels and into the insulation piercing notches of the terminal flanges;

and a corresponding plurality of bifurcated insertion guides, each located at the end of one insertion blade opposite the holding lug for that blade, for embracing each conductor at a point immediately beyond the strain relief retainer to guide the conductor into the associated retainer.

10. An electrical conductor mounting adapter tool according to claim 9 in which the adapter tool further comprises means for anchoring the adapter tool to the connector unit.

11. An electrical conductor mounting adapter tool according to claim 10 in which the anchoring means includes a pair of anchoring arms for engagement with opposite ends of the connector unit, each anchoring arm including a tapered free end to avoid interference with an anchoring arm of a second adapter tool during mounting of the adaptor tools on the connector unit.

12. An adapter tool for simultaneously mounting a plurality of insulation-covered electrical conductors in a corresponding plurality of contact members in a connector unit, each contact member including a terminal element comprising an elongated channel having one end shaped to receive a conductor and including at least one terminal flange with an outwardly-open insulation piercing notch for piercing the conductor insulation to complete an electrical connection to the conductor, the connector unit including a corresponding plurality of resilient outwardly-open strain relief retainers, one for each contact member, for capturing the conductor at the other end of the terminal element, the adapter tool comprising:

a corresponding plurality of holding lugs, one for each contact member, each adapted to engage one conductor and apply a holding pressure to the conductor to maintain the conductor engaged in said one end of the terminal element channel of a given contact member;

a corresponding plurality of insertion blades, each aligned with one holding lug, for pressing the conductors into the terminal element channels and into the insulation piercing notches of the terminal flanges;

and a plurality of stop members, each laterally disposed with respect to the insertion blade, for limiting insertion of all of the insertion blades to a uniform depth to avoid damage to the terminal flange.

13. An electrical conductor mounting tool according to claim 12 in which the adapter tool further comprises means for anchoring the adapter tool to the connector unit.

14. An electrical conductor mounting tool according to claim 13 in which the anchoring means includes a pair of anchoring arms for engagement with opposite ends of the connector unit, each anchoring arm including a tapered free end to avoid interference with an anchoring arm of a second adapter tool during mounting of the adapter tools on the connector unit.

15. Apparatus for mounting at least one insulation-covered electrical conductor in a corresponding contact member of a connector unit, the contact member including a terminal element comprising a channel having one end shaped to receive the conductor and including at least one terminal flange with an outwardly open insulation-piercing notch for piercing the conductor insulation to complete an electrical connection to the conductor, the connector unit including an outwardly open strain relief retainer for capturing the conductor at the other end of the terminal element, the apparatus comprising:

insertion means for inserting the conductor in response to the application of a force thereto, said insertion means including a first portion for engaging the conductor and applying a holding pressure to the conductor to maintain the conductor engaged in said one end of the terminal element channel, a second portion, aligned with said first portion, for pressing the conductor into the terminal element channel, into the insulation piercing notch of the terminal flange, and into the strain relief retainer, and a third portion for engaging the conductor at a point immediately beyond the strain relief retainer to guide the conductor into the retainer.

16. A tool for mounting an insulation-covered electrical conductor in a contact member of a connector unit, the contact member including a terminal element comprising a channel having one end shaped to receive the conductor and including at least one terminal flange with an outwardly open insulating piercing notch for piercing the conductor insulation to complete an electrical connection to the conductor, the connector unit including an outwardly open strain relief retainer for capturing the conductor at the other end of the terminal element, the tool comprising:

holding means for engaging the conductor and applying a holding pressure to the conductor to maintain the conductor engaged in said one end of the terminal element channel;

insertion means for pressing the conductor into the terminal element channel and into the insulation piercing notch of the terminal flange and into the strain relief retainer; and stop means for engaging the connector unit and limiting the depth of conductor insertion to avoid damage to the contact member.

17. A tool for mounting an insulation-covered electrical conductor in a contact member which is supported by a contact supporting structure, the contact member including a terminal element comprising a channel having one end shaped to receive the conductor and including at least one terminal flange with an outwardly open insulation piercing notch for piercing the conductor insulation to complete an electrical connection to the conductor, the contact member having an outwardly open strain relief retainer connected thereto for capturing the conductor at the other end of the terminal element, the tool comprising:

holding means for engaging the conductor and applying a holding pressure to the conductor to maintain the conductor engaged in said one end of the terminal element channel;

insertion means including a projection aligned with the holding means for pressing the conductor into the terminal element channel and into the insulation piercing notch of the terminal flange, and a portion for pressing the conductor into the strain relief retainer; and stop means for engaging the contact supporting structure for limiting the depth of conductor insertion to avoid damage to the contact member.

18. A tool for mounting an insulation-covered electrical conductor in a contact member of a connector unit, the contact member including a terminal element comprising a channel having one end shaped to receive the conductor and including at least one terminal flange with one outwardly open insulation piercing notch for piercing the conductor insulation to complete an electrical connection to the conductor, the connector unit including an outwardly open strain relief retainer for capturing the conductor at the other end of the terminal element, the tool comprising:

a holding portion for engaging the conductor and applying a holding pressure to the conductor to maintain the conductor engaged in said one end of the terminal element channel;

an insertion blade including a projection aligned with the holding portion for pressing the coductor into the terminal element channel and into the insulation piercing notch of the terminal flange, and a portion for pressing the conductor into the strain relief retainer; and stop means including at least one stop element for engaging the connector unit and limiting the depth of conductor insertion to avoid damage to the contact member.

19. The tool of claim 18, wherein said stop element projects laterally of said insertion blade.

20. The tool of claim 19 wherein said stop element comprise a surface projecting from said insertion blade at a distance from the insertion projection to define the depth of insertion.

21. A tool for mounting an insulation-covered electrical conductor in a contact member supported by a contact supporting structure, the contact member including a terminal element comprising a channel having one end shaped to receive the conductor and including at least one terminal flange with an outwardly open insulation piercing notch for piercing the conductor insulation to complete an electrical connection to the conductor, an outwardly open strain relief retainer mounted adjacent the contact member for capturing the conductor at the other end of the terminal element, the tool comprising:

a holding portion for engaging the conductor and applying a holding pressure to the conductor to maintain the conductor engaged in said one end of the terminal element channel and an insertion blade including a projection aligned with the holding portion for pressing the conductor into the terminal element channel and into the insulation piercing notch of the terminal flange, and a portion for pressing the conductor into the strain relief retainer; and stop means extending laterally of said insertion blade for engaging the contact supporting structure and limting the depth of insertion of the conductor to avoid damage to the contact member.

22. An adapter for an electrical connector which mounts a plurality of insulation-covered electrical conductors in a corresponding plurality of contact members in a connector unit, each contact member including a terminal element comprising an elongate channel having one end shaped to receive a conductor and including at least one terminal flange with an outwardly open insulation piercing notch for piercing the conductor insulation to complete an electrical connection to the connector unit including a corresponding plurality of resilient outwardly open strain relief retainers, one for each contact member, for capturing the conductor at the other end of the terminal element, the adapter providing additional strain relief and comprising:

a corresponding plurality of first portions, one for each contact member, each adapted to engage a respective conductor and apply a holding pressure to maintain the conductor in said one end of the terminal element channel of a given contact member;

a corresponding plurality of second portions, each aligned with a respective first portion, for engaging and applying a pressure to the conductors in the terminal element channels and the insulation piercing notches of the terminal flanges;

a corresponding plurality of third portions, each aligned with a respective second portion, for engaging and applying a pressure to the conductors in the strain relief retainers; and anchoring means for engaging and anchoring the adapter to the connector unit.

* * * * *